US012569105B2

(12) United States Patent
Wang et al.

(10) Patent No.: US 12,569,105 B2
(45) Date of Patent: Mar. 10, 2026

(54) CLEANING SYSTEM

(71) Applicant: SHENZHEN SILVER STAR INTELLIGENT GROUP CO., LTD., Shenzhen (CN)

(72) Inventors: Lin Wang, Shenzhen (CN); Lirong Ye, Shenzhen (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 345 days.

(21) Appl. No.: 18/220,249

(22) Filed: Jul. 10, 2023

(65) Prior Publication Data

US 2024/0032765 A1 Feb. 1, 2024

(30) Foreign Application Priority Data

Jul. 29, 2022 (CN) ..... 202210911029.X
Jul. 29, 2022 (CN) ..... 202210911187.5

(51) Int. Cl.
*A47L 11/40* (2006.01)

(52) U.S. Cl.
CPC ..... *A47L 11/4091* (2013.01); *A47L 2201/02* (2013.01)

(58) Field of Classification Search
CPC ..... A47L 11/4091; A47L 9/2873; A47L 2201/02; A47L 2201/028
See application file for complete search history.

(56) References Cited

U.S. PATENT DOCUMENTS

| | | | | |
|---|---|---|---|---|
| 2019/0059680 | A1 | 2/2019 | Fox et al. | |
| 2020/0000302 | A1* | 1/2020 | Morin | A47L 11/4005 |
| 2022/0079406 | A1* | 3/2022 | Zhang | A47L 11/4036 |

FOREIGN PATENT DOCUMENTS

| | | | |
|---|---|---|---|
| CN | 111345746 | A | 6/2020 |
| CN | 112369970 | A | 2/2021 |
| CN | 114424913 | A | 5/2022 |
| CN | 216417056 | U | 5/2022 |
| CN | 216417057 | U | 5/2022 |
| CN | 216417060 | U | 5/2022 |
| CN | 114652243 | A | 6/2022 |
| CN | 217013902 | U | 7/2022 |
| CN | 115251783 | A | 11/2022 |
| EP | 2263506 | A2 | 12/2010 |
| WO | 2021004546 | A1 | 1/2021 |
| WO | 2022096004 | A1 | 5/2022 |

OTHER PUBLICATIONS

International Search Report of PCT Patent Application No. PCT/CN2023/096948 issued on Nov. 23, 2023.

* cited by examiner

*Primary Examiner* — Andrew A Horton
(74) *Attorney, Agent, or Firm* — IPRO, PLLC; Na Xu

(57) ABSTRACT

A cleaning system includes a cleaning robot and a cleaning base station. The cleaning robot includes a machine body, a first cleaning assembly and a pushing assembly, the first cleaning assembly is detachably arranged on a bottom portion of the machine body, and the pushing assembly is at least partially arranged in the machine body and connected with the first cleaning assembly. when the cleaning robot is docked with the cleaning base station, the pushing assembly is capable of pushing the first cleaning assembly to move from a first state to a second state and/or from the second state to a third state.

17 Claims, 4 Drawing Sheets

100

CLEANING SYSTEM

CROSS-REFERENCE TO RELATED APPLICATIONS

The present application claims priorities of Chinese Patent Application No. 202210911187.5, filed on Jul. 29, 2022, titled "cleaning system" and Chinese Patent Application No. 202210911029.X, filed on Jul. 29, 2022, titled "cleaning base station and cleaning system", the contents of which are incorporated herein by reference.

TECHNICAL FIELD

The present application relates to the field of cleaning equipment, and in particular, relates to a cleaning system.

BACKGROUND

Cleaning robots currently available may include a variety of ground cleaning functions, for example, the cleaning robots include integrated robots which integrate a sweeping assembly with a mopping assembly, wherein the sweeping assembly can adsorb and clean the dust on the ground, while the mopping assembly can wet and clean the ground.

In some usage scenarios of cleaning robots, it is necessary for the cleaning robots to carry only part of cleaning assemblies for ground cleaning.

SUMMARY

An embodiment of the present application provides a cleaning system. The cleaning system includes a cleaning robot and a cleaning base station. The cleaning robot includes a machine body, a first cleaning assembly and a pushing assembly, the first cleaning assembly is detachably arranged on a bottom portion of the machine body, and the pushing assembly is at least partially arranged in the machine body and connected with the first cleaning assembly. when the cleaning robot is docked with the cleaning base station, the pushing assembly is capable of pushing the first cleaning assembly to move from a first state to a second state and/or from the second state to a third state.

BRIEF DESCRIPTION OF THE DRAWINGS

In order to explain embodiments of the present application or technical solutions in the prior art more clearly, attached drawings required in the description of the embodiments or the prior art will be briefly introduced below; obviously, the attached drawings in the following description are only some embodiments of the present application, and for those of ordinary skill in the art, other drawings can be obtained according to the structures shown in these attached drawings without creative labor.

DETAILED DESCRIPTION

Hereinafter, technical solutions in embodiments of the present application will be described clearly and completely with reference to attached drawings in the embodiments of the present application; obviously, the embodiments described are only part but not all of the embodiments of the present application. All other embodiments obtained by those of ordinary skill in the art based on the embodiments of the present application without creative labor belong to the scope claimed in the present application.

It shall be noted that, all directional indicators (such as up, down, left, right, front, back and so on) in the embodiment of the present application are only used to explain relative position relationships and movement situations or the like among components at a specific posture (as shown in the attached drawing); and if the specific posture changes, the directional indicators will change accordingly.

In addition, in the present application, descriptions with terms such as "first", "second" or the like are only used for descriptive purposes, and should not be understood as indicating or implying the relative importance thereof or implicitly indicating the number of indicated technical features. Therefore, features defined with "first" and "second" may explicitly or implicitly include at least one of the features. In addition, technical solutions among the embodiments can be combined with each other on the basis that they can be realized by those of ordinary skill in the art, and when the combination of the technical solutions is contradictory or impossible to be realized, it should be considered that such combination of the technical solutions does not exist, nor is it within the scope claimed in the present application.

An embodiment of the present application provides a cleaning system which can automatically complete the disassembly and installation of a first cleaning assembly so as to save manpower.

Figure 1:
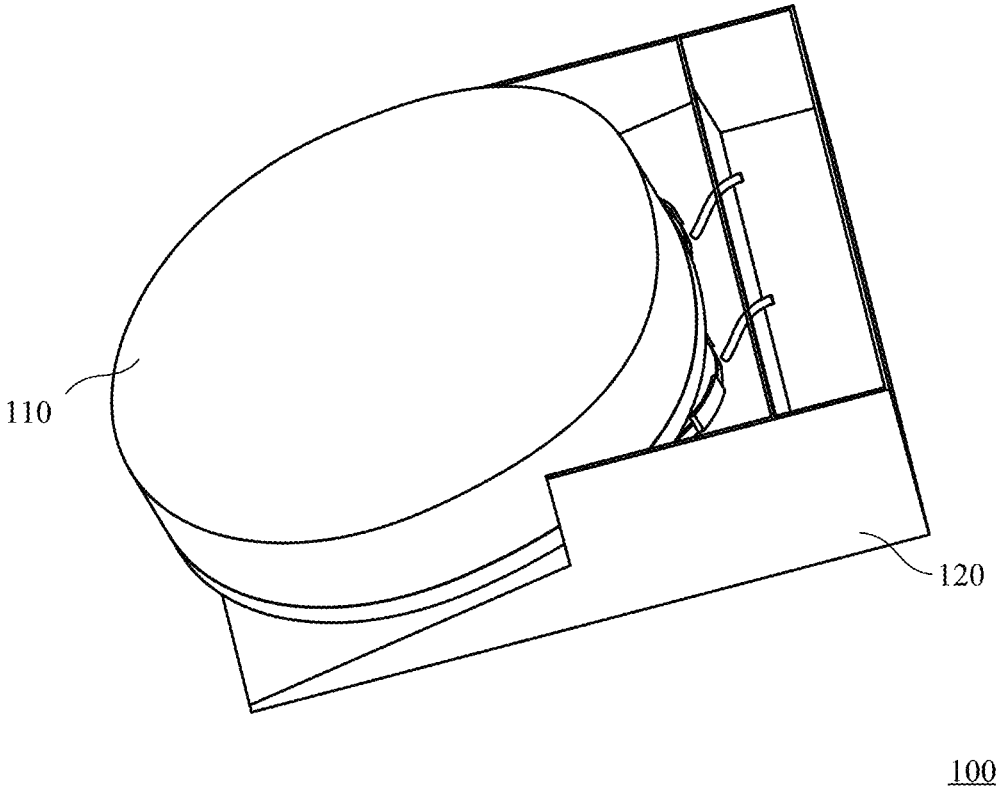
FIG. 1 is a schematic perspective view of a cleaning system according to an embodiment of the present application.
Figure 2:
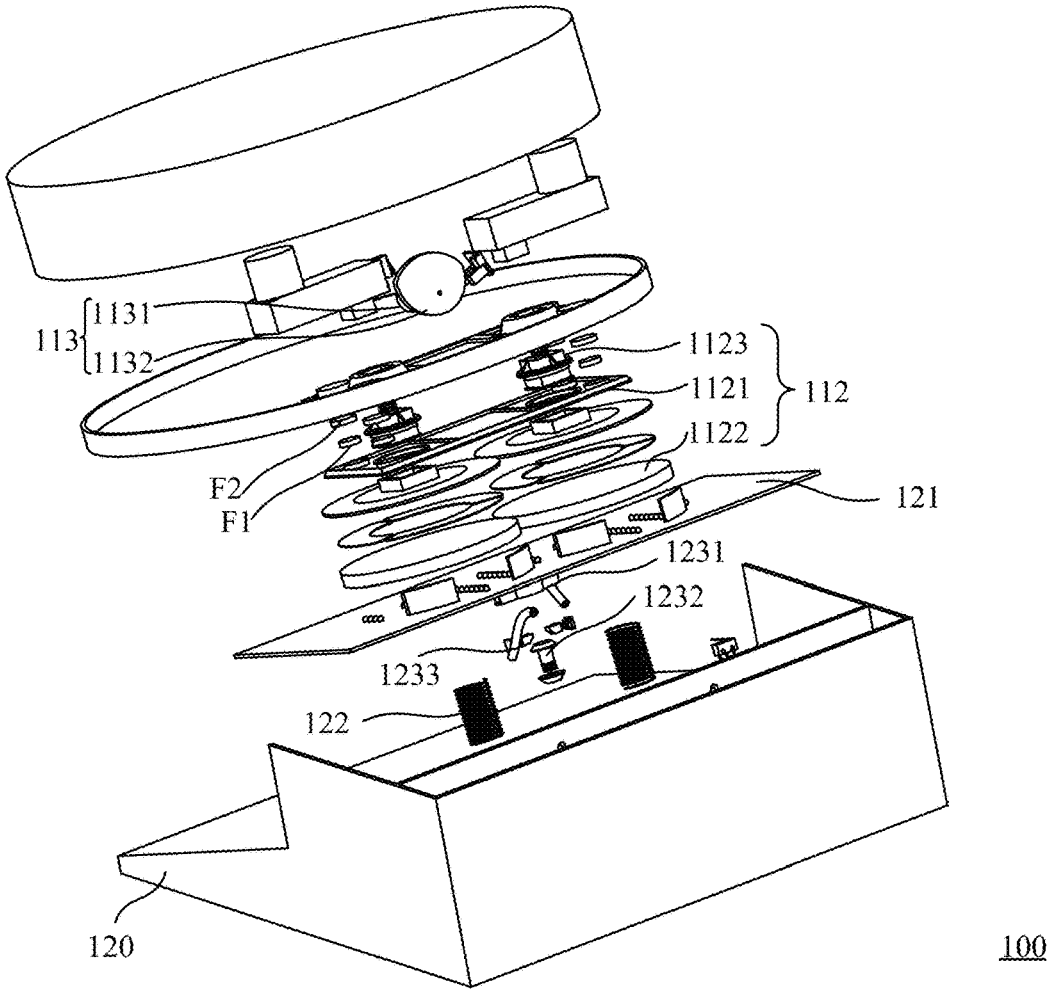
FIG. 2 is an exploded perspective view of the cleaning system according to an embodiment of the present application.

FIG. 1 is a schematic perspective view of a cleaning system according to an embodiment of the present application, and FIG. 2 is an exploded perspective view of the cleaning system according to an embodiment of the present application. In an embodiment of the present application, a cleaning system 100 includes a cleaning robot 110 and a cleaning base station 120. The cleaning robot 110 includes a machine body 111, a first cleaning assembly 112 and a pushing assembly 113, wherein the first cleaning assembly 112 is detachably arranged at the bottom portion of the machine body 111, and at least a part of the pushing assembly 113 is arranged in the machine body 111 and connected with the first cleaning assembly 112.

The cleaning base station 120 includes a station main body and a bearing plate 121, the bearing plate 121 is configured to bear the first cleaning assembly 112, the bearing plate 121 is movably positioned on the station main body, the bearing plate 121 is capable of moving between a first high position and a second high position, the bearing plate 121 is configured to receive or release the first cleaning assembly 112 in the first high position, the bearing plate 121 is configured to bear the first cleaning assembly 112 in the second high position, the first high position is higher than the second high position.

The cleaning base station 120 further includes a locking assembly 123 and a first elastic member 122, the locking assembly 123 is positioned on the station main body, the locking assembly 123 is configured to lock the bearing plate 121 in the second high position, and the first elastic member 122 is configured to drive the bearing plate 121 to return to the first high position after the bearing plate 121 is unlocked from the locking assembly 123. In some embodiments, the locking assembly 123 and the first elastic member 122 are connected with the bearing plate 121. The pushing assembly 113 is a power-driven assembly, the bearing plate 121 is located at the top portion of the cleaning base station 120 for bearing the weight of the first cleaning assembly 112, and under the action of the pushing assembly 113 and the first elastic member 122, the position of the bearing plate 121 will change.

When the cleaning robot 110 is docked with the cleaning base station 120, the pushing assembly 113 can push the first cleaning assembly 112 to move from a first state to a second state and/or from the second state to a third state.

For the cleaning system 110 provided according to the embodiment of the present application, the first cleaning assembly 112 is detachably arranged at the bottom portion of the machine body 111, the pushing assembly 113 is at least partially arranged in the machine body 111 and connected with the first cleaning assembly 112; when the cleaning robot 110 is docked with the cleaning base station 120, the pushing assembly 113 can push the first cleaning assembly 112 to move from the first state to the second state and/or from the second state to the third state, such that the first cleaning assembly 112 can be switched between multiple states through the pushing assembly 113; in this way, the first cleaning assembly 112 can be automatically connected with or separated from the machine body 111, thereby realizing automatic disassembly and assembly operation and saving manpower.

The bearing plate 121 is in the first high position when the first cleaning assembly 112 is in the first state, and the bearing plate 121 is in the second high position when the first cleaning assembly 112 is in the second state.

Figure 3:
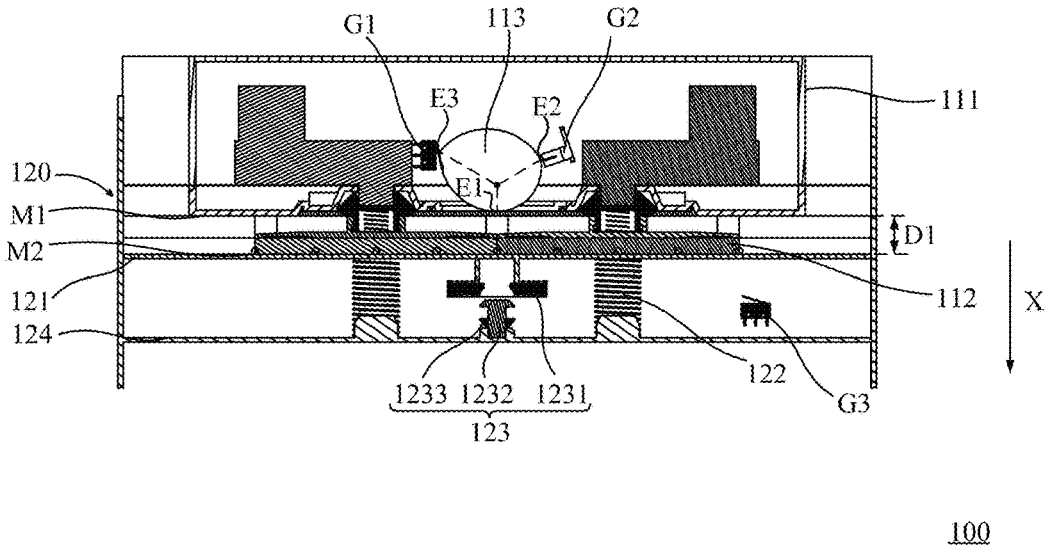
FIG. 3 is a schematic cross-sectional view of the cleaning system in a first state according to an embodiment of the present application.
Figure 4:
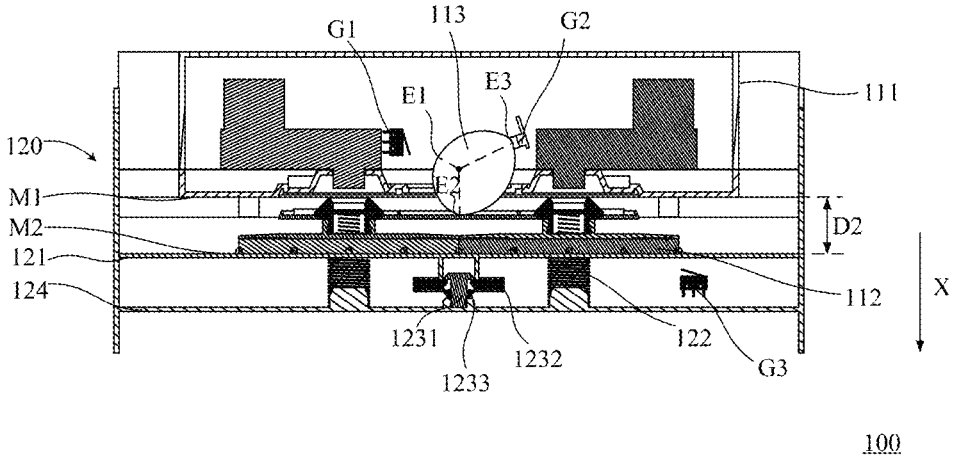
FIG. 4 is a schematic cross-sectional view of the cleaning system in a second state according to an embodiment of the present application.
Figure 5:
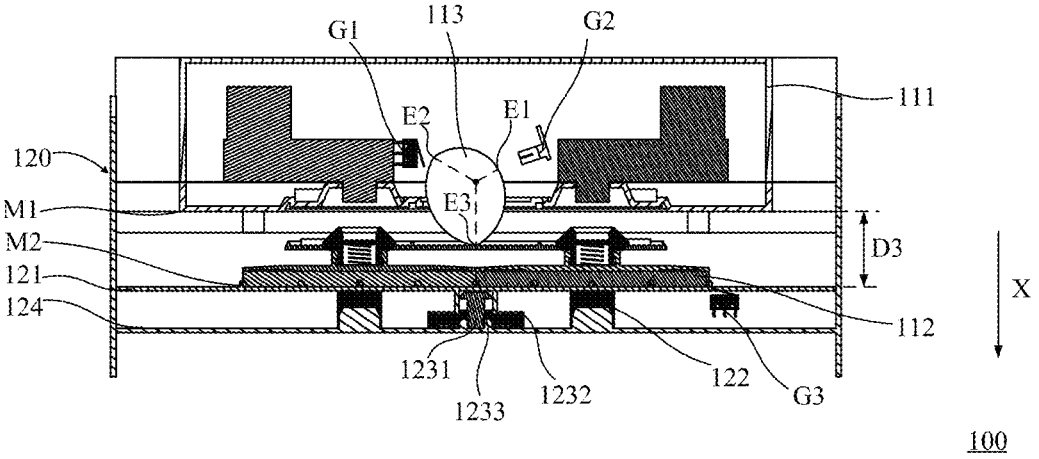
FIG. 5 is a schematic cross-sectional view of the cleaning system in a third state according to an embodiment of the present application.
Figure 6:
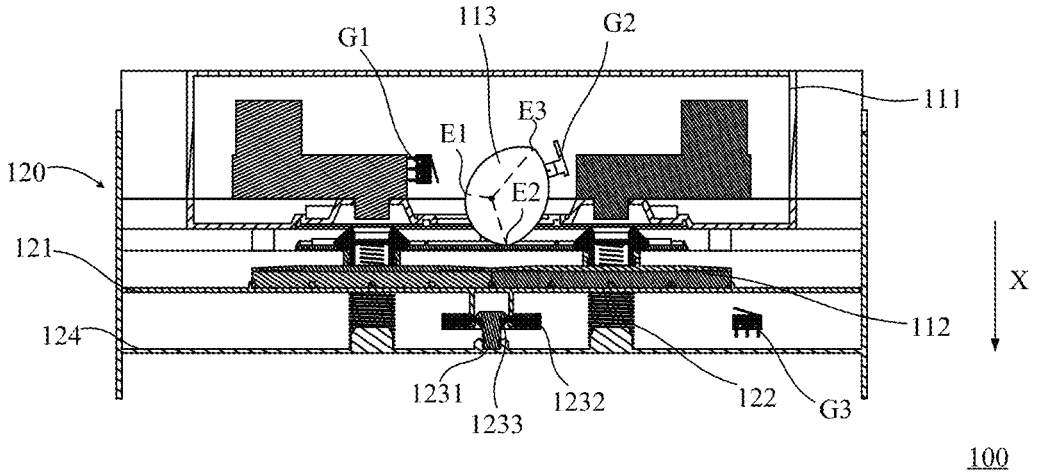
FIG. 6 is a schematic cross-sectional view of the cleaning system transitioning from the third state to the first state according to an embodiment of the present application.

FIG. 3 is a schematic cross-sectional view of the cleaning system in a first state according to an embodiment of the present application, FIG. 4 is a schematic cross-sectional view of the cleaning system in a second state according to an embodiment of the present application, FIG. 5 is a schematic cross-sectional view of the cleaning system in a third state according to an embodiment of the present application, and FIG. 6 is a schematic cross-sectional view of the cleaning system transitioning from the third state to the first state according to an embodiment of the present application; in the embodiment of the present application, when the cleaning robot 110 is docked with the cleaning base station 120, the pushing assembly 113 can push the first cleaning assembly 112 to move from the first state to the second state and/or from the second state to the third state. As shown in FIG. 3, in the first state, the first cleaning assembly 112 is connected with the machine body 111. As shown in FIG. 4, in the second state, the first cleaning assembly 112 is separated from the machine body 111, the bearing plate 121 bears the weight of the first cleaning assembly 112, and the locking assembly 123 locks the bearing plate 121. As shown in FIG. 5, in the third state, the locking assembly 123 unlocks the bearing plate 121. As shown in FIG. 6, it is the state when the locking assembly 123 changes the first cleaning assembly 112 from the third state to the first state.

The first cleaning assembly 112 is pushed to move from the first state to the second state and/or from the second state to the third state by the action of the pushing assembly 113. In the first state, the machine body 111 may be assembled with the first cleaning assembly 112, and the machine body 111 installed with the first cleaning assembly 112 works. In the second state and the third state, the machine body 111 may be separated from the first cleaning assembly 112, and the machine body 111 without the first cleaning assembly 112 can work alone at this time. The first elastic member 122 is configured to drive the first cleaning assembly 112 to return to the first state after the bearing plate 121 is unlocked. Under the action of the first elastic member 122, the bearing plate 121 is unlocked, and the first cleaning assembly 112 is driven to be reassembled on the bottom portion of the cleaning robot 110. The cleaning system 100 may automatically disassemble and assemble the first cleaning assembly 112, such that it is unnecessary for the cleaning robot 110 to manually disassemble and assemble the first cleaning assembly 112; since the disassembly and assembly of the first cleaning assembly 112 is automatically accomplished by the machine, the cleaning ability of the cleaning robot 110 is improved, and water can be prevented from entering the fan and wetting the carpet.

The bearing plate 121 is capable of moving to a third high position, the third high position is lower than the second high position, the bearing plate 121 is unlocked from the locking assembly 123 when the bearing plate 121 descends from the second high position to the third high position under an external force, i.e., under the action of the pushing assembly 113, and the bearing plate 121 is in the third high position when the first cleaning assembly 112 is in the third state.

In some embodiments, the cleaning robot 110 further includes a second cleaning assembly which is connected with the machine body 111, and at least one of the first cleaning assembly 112 and the second cleaning assembly is a mopping assembly, while the other is a sweeping assembly. The cooperation of the two cleaning assemblies can improve the cleaning efficiency of the cleaning robot 110 and make the cleaning intensity stronger. When the first cleaning assembly 112 is a mopping assembly, water can be prevented from entering the fan of the cleaning robot 110 in the case where the cleaning robot 110 does not carry the mopping assembly to work.

In some embodiments, the machine body 111 has a bottom surface M1 at the bottom portion thereof, and the first cleaning assembly 112 has a cleaning surface M2 that can contact and clean the ground, the first cleaning assembly 112 is detachably arranged at the bottom portion of the machine body 111; and as shown in FIG. 3, in a first state, there is a first distance D1 between the cleaning surface M2 and the bottom surface M1 of the machine body. As shown in FIG. 4, in a second state, there is a second distance D2 between the cleaning surface M2 and the bottom surface M1 of the machine body. As shown in FIG. 5, in the third state, there is a third distance D3 between the cleaning surface M2 and the bottom surface M1 of the machine body, wherein the third distance D3 is greater than the second distance D2, and the second distance D2 is greater than the first distance D1.

In some embodiments, as shown in FIG. 3, the clean base station 120 further includes a bottom plate 124, the bottom plate 124 is positioned below the bearing plate 121, and the first elastic member 122 elastically connects the bearing plate 121 with the bottom plate 124. The locking assembly 123 includes a clamping device 1231, a locking post 1232 and an unlocking component 1233. The clamping device 1231 is arranged on a side of the bearing plate 121 adjacent to the bottom plate 121, the locking post 1232 is fixedly connected with the bottom plate 124, and when the clamping device 1231 together with bearing plate 121 descends to the second high position, the clamping device 1231 clamps the locking post 1232, such that the locking assembly 123 locks the bearing plate 121. The unlocking component 1233 is movably arranged on the sidewall of the locking post 1232, and when the clamping device 1231 together with the bearing plate 121 descends to the third high position, the unlocking component 1233 releases the clamping of the locking post 1232 by the clamping device 1231, such that the locking assembly 123 unlocks the bearing plate 121. The changes of the positions of the clamping device 1231, the locking post 1232 and the unlocking component 1233 can realize the intelligent switching between the first state, the second state and the third state, which can save manpower and improve the user experience.

Figure 7:
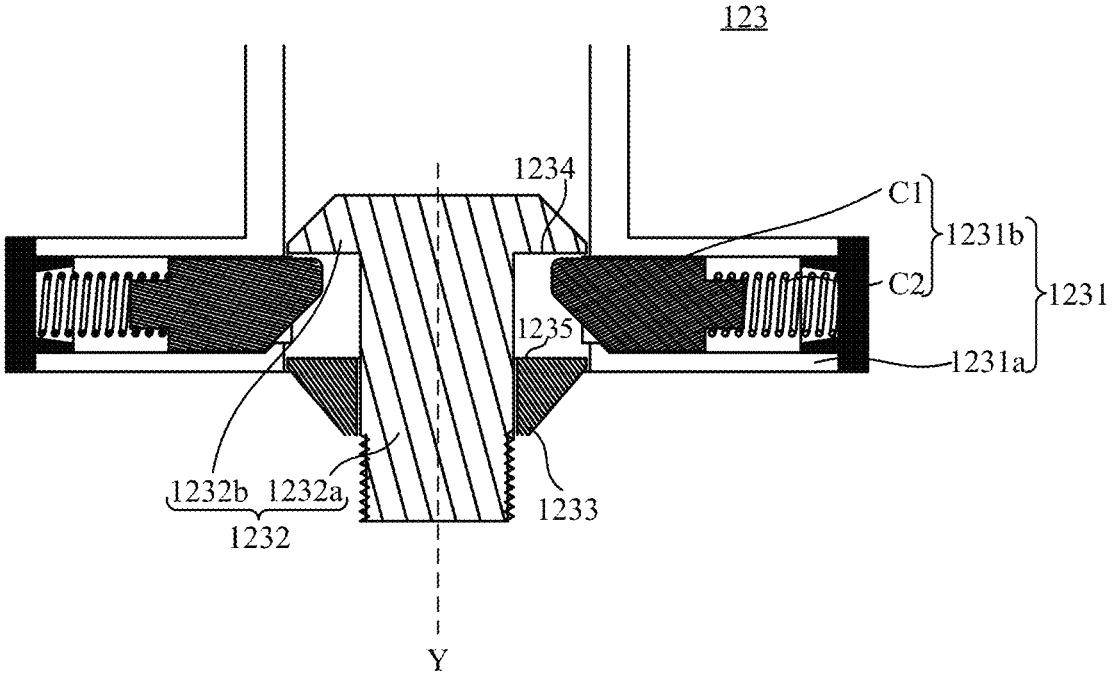
FIG. 7 is a schematic cross-sectional view of a locking assembly of the cleaning system according to an embodiment of the present application.

FIG. 7 is a schematic cross-sectional view of a locking assembly of the cleaning system according to an embodiment of the present application. In some embodiments, the clamping device 1231 includes a mounting bracket 1231*a* and at least one pair of clamping assemblies 1231*b*, each of the clamping assemblies 1231*b* includes a clamping block C1 and a second elastic member C2, the second elastic member C2 connects the clamping block C1 with the mounting bracket 1231*a*, and the second elastic member C2 makes the two clamping blocks C1 of each pair of clamping assemblies 1231*b* approach each other. The mounting bracket 1231*a* supports the clamping assembly 1231*b*, the clamping assembly 1231*b* is mounted on the mounting bracket 1231*a*, and the second elastic member C2 enables the clamping block C1 to elastically move relative to the mounting bracket 1231*a*, such that it is convenient for the clamping block C1 to abut against the locking post 1232 and the unlocking component 123 to perform state switching.

In some embodiments, as shown in FIG. 7, the locking post 1232 includes a guiding part 1232*a* and a locking part 1232*b*, the guiding part 1232*a* is connected between the locking part 1232*b* and the bottom plate 124, the maximum peripheral size of the locking part 1232*b* is larger than the peripheral size of the guiding part 1232*a*, the locking part 1232*b* has a clamping surface 1234 facing the bottom plate 124, and when the clamping block C1 abuts against the clamping surface, the locking assembly 123 locks the bearing plate 121. The locking part 1232*b* has a first transition section, and the distance from the outer peripheral surface of the first transition section to the central axis Y of the guiding part 1232*a* gradually increases along the direction X from the bearing plate 121 to the bottom plate 124. The guiding part 1232*a* can make the unlocking component 1233 slide directionally, and the locking part 1232*b* makes the unlocking component 1233 limited to the guiding part 1232*a*. The maximum peripheral dimension of the locking part 1232*b* is larger than the peripheral dimension of the guiding part 1232*a*, which facilitates the separation of the clamping block C1 from the locking post 1232, such that the first cleaning assembly 112 is assembled at the bottom portion of the cleaning robot 110. The locking part 1232*b* has a first transition section, the distance from the outer peripheral surface of the first transition section to the central axis Y of the guiding part 1232*a* gradually increases along the direction X from the bearing plate 121 to the bottom plate 124, and optionally, the locking part 1232*b* is a platform body. The design of the first transition section facilitates the sliding of the clamping block C1 along the outer peripheral surface of the locking part 1232*b* and makes the clamping block C1 abut against the clamping surface 1234.

In some embodiments, as shown in FIG. 7, the unlocking component 1233 includes a sliding block slidably arranged at the periphery of the guiding part 1232*a* along the axial direction of the guiding part 1232*a*, the sliding block has a second transition section, and the distance from the outer peripheral surface of the second transition section to the central axis Y of the guiding part 1232*a* gradually decreases along the direction X from the bearing plate 121 to the bottom plate 124; surfaces facing each other of the two clamping blocks C1 of each pair of clamping assemblies 1231*b* are resisting surfaces, the clamping block C1 has a third transition section, and the distance from the resisting surface of the third transition section to the central axis Y of the guiding part 1232*a* gradually increases along the direction X from the bearing plate 121 to the bottom plate 124, and when the clamping block C1 clamps the second transition section of the sliding block, the locking assembly 123 unlocks the bearing plate 121. The design of the second transition section enables the clamping block C1 to slide along the outer peripheral surface of the sliding block, and the clamping block C1 can drive the sliding block to move. The cooperation of different mechanical structures can realize the switching between different states.

In some embodiments, the sliding block has an engagement surface 1235 capable of engaging with the clamping surface 1234 by sliding, and the engagement surface 1235 can cover the clamping surface 1234. The engagement surface 1235 can cover the clamping surface 1234, such that the clamping block C1 can be separated from the locking post 1232.

In some embodiments, the pushing assembly 113 includes a rotary driving member 1131 and a cam 1132. The rotary driving member 1131 drives the cam 1132 to rotate. The periphery of the cam 1132 abuts against the first cleaning assembly 112, the periphery of the cam 1132 has a first end point E1, a second end point E2 and a third end point E3, and the distances respectively from the first end point E1, the second end point E2 and the third end point E3 to the rotation center of the cam 1132 increase in sequence. As shown in FIG. 3, when the first end point E1 abuts against the first cleaning assembly 112, the first cleaning assembly 112 is in the first state. As shown in FIG. 4, when the second end point E2 abuts against the first cleaning assembly 112, the first cleaning assembly 112 is in the second state. As shown in FIG. 5, when the third end point E3 abuts against the first cleaning assembly 112, the first cleaning assembly 112 is in the third state. The cam 1132 may be a complete disk, or the cam 1132 may be a semicircle, a circle or the like, so long as there is a distance difference from the rotation center point of the cam 1132 to the edge of the cam 1132. When the cam 1132 rotates, it can rotate around the center point other than the center of circle of the first cam 1132, which ensures that various heights are possible for the bearing plate 121 during the working process, so as to realize the state change of the first cleaning assembly 112.

In some embodiments, the cleaning robot 110 further includes a first state detector G1 and a second state detector G2, the first state detector G1 and the second state detector G2 are arranged on the peripheral side of the cam 1132 and are electrically connected with the rotary driving member 1131, the first state detector G1 is configured to be triggered to provide a first in-place information when the cam 1132 rotates to make the first cleaning assembly 112 in the first state, and the second state detector G2 is configured to be triggered to provide a second in-place information when the cam 1132 rotates to make the first cleaning assembly 112 in the second state. Optionally, the first state detector G1 is a first micro-switch, and when the cam 1132 rotates to make the first cleaning assembly 112 in the first state, the third end point E3 of the cam 1132 contacts the first micro-switch, such that the first micro-switch provides the first in-place information; the second state detector G2 is a light sensor, and when the cam 1132 rotates to make the first cleaning assembly 112 in the second state, the third end point E3 of the cam 1132 shields the light sensor, such that the light sensor provides the second in-place information. The first micro-switch and the light sensor make it more sensitive to position detection of the cam 1132.

In some embodiments, the cleaning base station 120 further includes a third state detector G3 which is arranged between the bearing plate 121 and the bottom plate 124, and the third state detector G3 is configured to be triggered to provide a third in-place information when the first cleaning assembly 112 is in the third state. The third state detector G3 is a second micro-switch, and when the bearing plate 121 moves to make the first cleaning assembly 112 in the third state, the bearing plate 121 contacts the second micro-switch, such that the second micro-switch provides the third in-place information.

In some embodiments, the cleaning base station 120 further includes a water supply mechanism and a sewage discharge mechanism, the bearing plate 121 is provided with a cleaning structure and a drainage hole structure, and the water supply mechanism is configured to be triggered to provide clean water to the first cleaning assembly 112 when the bearing plate 121 carries the first cleaning assembly 112. The first cleaning assembly 112 can be cleaned by the cleaning structure of the bearing plate 121, and the sewage discharge mechanism is configured to discharge the sewage on the bearing plate 121 through the drainage hole structure. Wherein, the cleaning structure may include one or more convex scraping structure, and the convex scraping structure can scrap and clean the first cleaning assembly 112. The water supply mechanism may include a water pump, a clean water tank and a water supply pipe, and the clean water in the clean water tank can be supplied to the first cleaning assembly 112 through the water pump and the water supply pipe. The sewage discharge mechanism may include a sewage pump and a sewage pipe, and the sewage on the bearing board 121 can be discharged through the sewage pump and the sewage pipe.

In some embodiments, the first cleaning assembly 112 includes a connecting plate 1121, a cleaning member 1122, and a connecting component 1123. The cleaning robot 110 further includes a driving assembly which is detachably connected with the connecting component 1123. The connecting component 1123 connects the cleaning member 1122 and the connecting plate 1121. At least one of the machine body 111 and the connecting plate 1121 is provided with an attraction component, and the attraction component is capable of connecting the connecting plate 1121 with the machine body 111 through attraction. The cleaning member 1122 has a cleaning function, and when the first cleaning assembly 112 works, the cleaning member 1122 is in direct contact with the cleaning surface M2. Optionally, the attraction may also be achieved by magnetic attraction, wherein the bottom portion of the machine body 111 is provided with a magnet F2, and the surface of the connecting plate 1121 is provided with an iron block F1; when the distance between the magnet F2 and the iron block F1 is within an attraction range under the action of the pushing assembly 113, the machine body 111 can be magnetically connected with the connecting plate 1121.

For the cleaning system 100 according to the embodiment of the present application, when the pushing assembly 113 pushes the first cleaning assembly 112 to move from the first state to the second state, the first cleaning assembly 112 is separated from the machine body 111, and the first cleaning assembly 112 is temporarily stored in the cleaning base station 120, such that the automatic disassembly of the first cleaning assembly 112 from the cleaning robot 110 is realized; and at this time, the cleaning robot 110 can work without carrying the first cleaning assembly 112. When the pushing assembly 113 pushes the first cleaning assembly 112 to move from the second state to the third state, the locking assembly 123 unlocks the bearing plate 121, and then the first elastic member 122 makes the first cleaning assembly 112 move from the third state to the first state, such that the first cleaning assembly 112 is connected with the machine body 111 again, and the automatic installation of the first cleaning assembly 112 to the cleaning robot 110 is realized; and at this point, the cleaning robot 110 can work while carrying the first cleaning assembly 112. For the cleaning system 100 according to the embodiment of the present application, it is unnecessary for the cleaning robot 110 to disassemble and assemble the first cleaning assembly 112 manually, thereby improving the intelligence of the cleaning system 100 and facilitating the improvement of the cleaning ability of the cleaning robot 110 in some scenes.

What described above are only the exemplary embodiments of the present application, but are not intended to limit the protective scope of the present application; any equivalent structures or equivalent process flow modifications that are made according to the specification and the attached drawings of the present application, or any direct or indirect applications of the present application in other related technical fields shall all be covered within the protective scope of the present application.

What is claimed is:

1. A cleaning system, comprising:

a cleaning robot, comprising a machine body, a first cleaning assembly and a pushing assembly, the first cleaning assembly detachably arranged on a bottom portion of the machine body, and the pushing assembly at least partially arranged in the machine body and connected with the first cleaning assembly; and a cleaning base station, comprising a bearing plate, a locking assembly and a first elastic member;

wherein when the cleaning robot is docked with the cleaning base station, the pushing assembly is capable of pushing the first cleaning assembly to move from a first state to a second state and/or from the second state to a third state;

in the first state, the first cleaning assembly is connected with the machine body; in the second state, the first cleaning assembly is separated from the machine body, the bearing plate bears a weight of the first cleaning assembly, the locking assembly locks the bearing plate; and in the third state, the locking assembly unlocks the bearing plate;

the first elastic member is configured to drive the first cleaning assembly to return to the first state after the bearing plate is unlocked.

2. The cleaning system of claim 1, wherein the machine body comprises a bottom surface, the first cleaning assembly comprises a cleaning surface capable of contacting and cleaning the ground;

in the first state, there is a first distance between the cleaning surface and the bottom surface of the machine body; in the second state, there is a second distance between the cleaning surface and the bottom surface of the machine body; and in the third state, there is a third distance between the cleaning surface and the bottom surface of the machine body, wherein the third distance is greater than the second distance and the second distance is greater than the first distance.

3. The cleaning system of claim 1, wherein the cleaning base station further comprises a bottom plate, the first elastic member elastically connects the bearing plate and the bottom plate, and the locking assembly comprises:

a clamping device, arranged on the bearing plate;

a locking post, fixedly connected with the bottom plate, and when the clamping device clamps the locking post, the locking assembly locks the bearing plate; and an unlocking component, arranged on the locking post, and when the unlocking component releases the clamping of the locking post by the clamping device, the locking assembly unlocks the bearing plate.

4. The cleaning system of claim 3, wherein the clamping device comprises a mounting bracket and at least one pair of clamping assemblies, each of the clamping assemblies comprises a clamping block and a second elastic member, the second elastic member connects the clamping block and the mounting bracket, and the second elastic member makes the two clamping blocks of each pair of clamping assemblies approach each other.

5. The cleaning system of claim 4, wherein the locking post comprises a guiding part and a locking part, the guiding part is connected between the locking part and the bottom plate, a maximum peripheral dimension of the locking part is larger than a peripheral dimension of the guiding part, the locking part comprises a clamping surface facing the bottom plate, and when the clamping block abuts against the clamping surface, the locking assembly locks the bearing plate;

wherein the locking part comprises a first transition section, and a distance from an outer peripheral surface of the first transition section to a central axis of the guiding part gradually increases along a direction from the bearing plate to the bottom plate.

6. The cleaning system of claim 5, wherein the unlocking component comprises a sliding block slidably arranged at a periphery of the guiding part along an axial direction of the guiding part, the sliding block comprises a second transition section, and a distance from an outer peripheral surface of the second transition section to the central axis of the guiding part gradually decreases along the direction from the bearing plate to the bottom plate;

surfaces facing each other of the two clamping blocks of each pair of clamping assemblies are resisting surfaces, each clamping block comprises a third transition section, and a distance from the resisting surface of the third transition section to the central axis of the guiding part gradually increases along the direction from the bearing plate to the bottom plate;

when the clamping block clamps the second transition section of the sliding block, the locking assembly unlocks the bearing plate.

7. The cleaning system of claim 6, wherein the sliding block comprises an engagement surface capable of engaging with the clamping surface by sliding, and the engagement surface is capable of covering the clamping surface.

8. A cleaning system, comprising:

a cleaning robot, comprising a machine body, a first cleaning assembly and a pushing assembly, the first cleaning assembly detachably arranged on a bottom portion of the machine body, and the pushing assembly at least partially arranged in the machine body and connected with the first cleaning assembly; and a cleaning base station;

wherein when the cleaning robot is docked with the cleaning base station, the pushing assembly is capable of pushing the first cleaning assembly to move from a first state to a second state and/or from the second state to a third state;

the pushing assembly comprises:

a rotary driving member; and a cam, wherein the rotary driving member is capable of driving the cam to rotate, a periphery of the cam abuts against the first cleaning assembly, the periphery of the cam comprises a first end point, a second end point and a third end point, and distances respectively from the first end point, the second end point and the third end point to a rotation center of the cam increase in sequence, when the first end point abuts against the first cleaning assembly, the first cleaning assembly is in the first state;

when the second end point abuts against the first cleaning assembly, the first cleaning assembly is in the second state;

when the third end point abuts against the first cleaning assembly, the first cleaning assembly is in the third state.

9. The cleaning system of claim 8, wherein the cleaning robot further comprises a first state detector and a second state detector, the first state detector and the second state detector are arranged on a peripheral side of the cam and are electrically connected with the rotary driving member, the first state detector is configured to be triggered to provide a first in-place information when the cam rotates to make the first cleaning assembly in the first state, and the second state detector is configured to be triggered to provide a second in-place information when the cam rotates to make the first cleaning assembly in the second state.

10. The cleaning system of claim 9, wherein the first state detector is a first micro-switch, and when the cam rotates to make the first cleaning assembly in the first state, the third end point of the cam contacts the first micro-switch, such that the first micro-switch provides the first in-place information;

the second state detector is a light sensor, and when the cam rotates to make the first cleaning assembly in the second state, the third end point of the cam shields the light sensor, such that the light sensor provides the second in-place information.

11. The cleaning system of claim 9, wherein the cleaning base station further comprises a third state detector which is arranged between the bearing plate and the bottom plate, and the third state detector is configured to be triggered to provide a third in-place information when the first cleaning assembly is in the third state.

12. The cleaning system of claim 11, wherein the third state detector is a second micro-switch, and when the bearing plate moves to make the first cleaning assembly in the third state, the bearing plate contacts the second micro-switch, such that the second micro-switch provides the third in-place information.

13. A cleaning system, comprising:

a cleaning robot, comprising a machine body, a first cleaning assembly and a pushing assembly, the first cleaning assembly detachably arranged on a bottom portion of the machine body, and the pushing assembly at least partially arranged in the machine body and connected with the first cleaning assembly; and a cleaning base station, comprising a station main body and a bearing plate;

wherein when the cleaning robot is docked with the cleaning base station, the pushing assembly is capable of pushing the first cleaning assembly to move from a first state to a second state and/or from the second state to a third state;

the bearing plate is configured to bear the first cleaning assembly, the bearing plate is movably positioned on the station main body, the bearing plate is capable of moving between a first high position and a second high position, the bearing plate is configured to receive or release the first cleaning assembly in the first high position, the bearing plate is configured to bear the first cleaning assembly in the second high position, the first high position is higher than the second high position, the bearing plate is in the first high position when the first cleaning assembly is in the first state, and the bearing plate is in the second high position when the first cleaning assembly is in the second state;

the cleaning base station further comprises a locking assembly and a first elastic member, the locking assembly is positioned on the station main body, the locking assembly is configured to lock the bearing plate in the second high position, and the first elastic member is configured to drive the bearing plate to return to the first high position after the bearing plate is unlocked from the locking assembly.

14. The cleaning system of claim 13, wherein the bearing plate is capable of moving to a third high position, the third high position is lower than the second high position, the bearing plate is unlocked from the locking assembly when the bearing plate descends from the second high position to the third high position under an external force, and the bearing plate is in the third high position when the first cleaning assembly is in the third state.

15. The cleaning system of claim 13, wherein the cleaning base station further comprises a bottom plate positioned below the bearing plate, the first elastic member is elastically connected the bearing plate and the bottom plate, the locking assembly comprises:

a clamping device, arranged on a side of the bearing plate adjacent to the bottom plate;

a locking post, fixedly connected with the bottom plate, and when the clamping device together with bearing plate descends to the second high position, the clamping device clamps the locking post, such that the locking assembly locks the bearing plate.

16. The cleaning system of claim 15, wherein the cleaning base station further comprises an unlocking component, when the clamping device together with the bearing plate descends to a third high position, the unlocking component releases the clamping of the locking post by the clamping device, such that the locking assembly unlocks the bearing plate, the third high position is lower than the second high position, and the bearing plate is in the third high position when the first cleaning assembly is in the third state.

17. The cleaning system of claim 15, wherein the clamping device comprises a mounting bracket and at least one pair of clamping assemblies, each of the clamping assemblies comprises a clamping block and a second elastic member, the second elastic member connects the clamping block and the mounting bracket, and the second elastic member makes the two clamping blocks of each pair of clamping assemblies approach each other.

* * * * *